US007692418B2

(12) United States Patent
Jeong

(10) Patent No.: US 7,692,418 B2
(45) Date of Patent: Apr. 6, 2010

(54) BAND GAP REFERENCE CIRCUIT AND TEMPERATURE INFORMATION OUTPUT APPARATUS USING THE SAME

(75) Inventor: Chun-Seok Jeong, Ichon-shi (KR)

(73) Assignee: Hynix Semiconductor, Inc., Gyeonggi-do (KR)

( * ) Notice: Subject to any disclaimer, the term of this patent is extended or adjusted under 35 U.S.C. 154(b) by 481 days.

(21) Appl. No.: 11/647,485

(22) Filed: Dec. 29, 2006

(65) Prior Publication Data

US 2008/0061760 A1 Mar. 13, 2008

(30) Foreign Application Priority Data

Sep. 13, 2006 (KR) ..... 10-2006-0088739

(51) Int. Cl.
*G05F 3/16* (2006.01)

(52) U.S. Cl. ..... 323/314; 323/315; 323/907; 327/539

(58) Field of Classification Search ..... 323/313, 323/314, 907; 327/539
See application file for complete search history.

(56) References Cited

U.S. PATENT DOCUMENTS 5,784,328 A 7/1998 Irrinki et al.
6,181,121 B1 1/2001 Kirkland et al.
6,281,760 B1 8/2001 Koelling et al.
7,009,904 B2 3/2006 Kim
7,078,958 B2 * 7/2006 Gower et al. ..... 327/539
7,127,368 B2 * 10/2006 Choi ..... 702/130
2005/0270011 A1 * 12/2005 Aota et al. ..... 323/315
2006/0103455 A1 5/2006 Zhang et al.
2006/0111865 A1 5/2006 Choi
2006/0190210 A1 * 8/2006 Mukherjee ..... 702/130

FOREIGN PATENT DOCUMENTS

JP 2005216040 8/2005
KR 1020010003402 1/2001
KR 1020060053414 5/2006

* cited by examiner

*Primary Examiner*—Jeffrey L Sterrett
*Assistant Examiner*—Fred E Finch, III
(74) *Attorney, Agent, or Firm*—Venable LLP; Jeffri A. Kaminski

(57) ABSTRACT

A BGR circuit includes a temperature-proportional current generating part configured to generate a current in proportion to a change in temperature through a plurality of current paths; a temperature-inverse proportional current generating part generates a current in inverse proportion to a change in temperature through a plurality of current paths. An internal voltage reference voltage generating part generates a reference voltage for an internal voltage using the current of the temperature-proportional current generating part and the current of the temperature-inverse proportional current generating part. A temperature voltage output part outputs a voltage corresponding to a change in temperature.

7 Claims, 7 Drawing Sheets

BAND GAP REFERENCE CIRCUIT AND TEMPERATURE INFORMATION OUTPUT APPARATUS USING THE SAME

FIELD OF THE INVENTION

1. Technical Field

The present invention disclosed herein relates to a band gap reference circuit and a temperature information output apparatus using the same.

2. Related Art

A conventional temperature information output apparatus 100 comprises a band gap reference (BGR) circuit 110, an analog-to-digital converter (ADC) 120, and a controller 140, as shown in FIG. 1. A BGR circuit 200 which generates a reference voltage VREF_CORE used to generate a semiconductor memory apparatus internal voltage is further arranged in a semiconductor memory apparatus, separate from the BGR circuit 110 of the temperature information output apparatus 100.

The BGR circuit 110 of the temperature information output apparatus 100 outputs a temperature voltage VTEMP which is in inverse pro portion to a semiconductor memory apparatus internal temperature, a reference voltage VULIMIT for defining an upper limit of the temperature voltage VTEMP, and a reference voltage VLLIMIT for defining a lower limit of the temperature voltage VTEMP. The BGR circuit 110, as shown in FIG. 2, comprises a switch SW for supplying electric power to the BGR circuit 110 in response to a BGR_ON signal, a temperature-proportional current generating part 111, a temperature-inverse proportional current generating part 112, a current-to-voltage converting part 113, a reference voltage output part 114, and a temperature voltage output part 115. The temperature-proportional current generating part 111 generates a basic current IPTAT which increases as the semiconductor memory apparatus internal temperature increases. The temperature-inverse proportional current generating part 112 generates a basic current ICTAT which decreases as the semiconductor memory apparatus internal temperature increases. The current-to-voltage converting part 113 converts the sum of a basic current M*IPTAT that is proportional to the size of a transistor XM and a basic current K*ICTAT that is proportional to the size of a transistor XK to a voltage VREF using a resistor R3. The reference voltage output part 114 outputs the reference voltage VULIMIT that defines the upper limit of the temperature voltage VTEMP, and the reference voltage VLLIMIT that defines the lower limit of the temperature voltage VTEMP. The reference voltages VULIMIT and VLLIMIT may be offset by various factors, and thus they can be adjusted by varying the values of resistors R5, R7 and R8 when an external adjusting code is input. The temperature voltage output part 115 amplifies an emitter-base voltage VEB2 of a bipolar junction transistor (BJT) Q2 in the temperature-proportional current generating part 111 to output the temperature voltage VTEMP. Here, since the emitter-base voltage VEB2 has a characteristic of −1.8 mV/° C., it is used as a voltage for generating the temperature voltage.

The BGR circuit 200 arranged in the semiconductor memory apparatus does not need to generate VTEMP, VULIMIT and VLLIMIT, and thus it does not include the reference voltage output part 114 and the temperature voltage output part 115 in the BGR circuit 110 of the temperature information output apparatus 100.

The ADC 120 converts the temperature voltage VTEMP to digital temperature information TEMP_CODE. The ADC 120, as shown in FIG. 3, comprises: a comparator 121, a filter 122, a counter 123, an oscillator 124, a multiplexer MUX 125, a decoder 126, and a digital-to-analog converter (DAC) 127. The comparator 121 compares VTEMP and DACOUT, which are analog values, to output a difference between VTEMP and DACOUT as digital codes INC and DEC. The filter 122 does not perform an output operation when INC and DEC vary radically, that is, when they have a high frequency component due to an external noise. However, when INC and DEC vary dilatorily, the filter 122 outputs a signal UP for the counter 123 to up-count and a signal DN signal for the counter 123 down-count only for a low frequency component. The counter 123 increases and decreases an initial TEMP_CODE (e.g., 100000) in response to the UP and DN signals, respectively. The counter 123 receives an ADC_ON signal through a reset terminal RESET. The oscillator 124 operates when the ADC_ON signal is at high level to generate a clock signal having a predetermined period, and provides the clock to the filter 122 and the counter 123 through a delay DLY. The multiplexer MUX 125 outputs a test code TEST_CODE or TEMP_CODE in response to a test mode signal TM. The decoder 126 decodes an output of the multiplexer MUX 125 to output a decoding signal SW<0:N>. The DAC 127 converts the decoding signal SW<0:N> to DACOUT to the extent that VULIMIT and VLLIMIT are not exceeded.

The controller 140 outputs the BGR_ON signal, the ADC_ON signal and the test mode signal TM to control whether to perform a test mode or not in response to an enable signal EN, a self refresh signal SREF, and a test mode enable signal TEST_EN, which are external signals input to the temperature information output apparatus 100.

An operation of the conventional temperature information output apparatus will be described below with reference to FIG. 4.

First, the controller 140 enables the BGR_ON signal to high level when it receives an EN signal.

The BGR circuit 110 operates when the BGR_ON signal is at high level and performs a temperature detecting operation to output VTEMP, VULIMIT and VLLIMIT.

The controller 140 enables the ADC_ON signal to high level after VTEMP, VULIMIT and VLLIMIT become stabilized, that is, after a time corresponding to a band gap initialization operation lapses.

The ADC 120 performs an ADC tracking operation while the ADC_ON signal is at high level.

When the ADC tracking operation is almost finished DACOUT and VTEMP become equal in level, and when the ADC tracking operation is complete the ADC 120 outputs TEMP_CODE.

As the ADC_ON signal becomes low level, the counter 123 output of the ADC 120 is reset to a previously set initial value.

When the above-described operation is completed, that is, the BGR_ON signal becomes low level, the operation of the temperature information output apparatus is finished, and TEMP_CODE output from the ADC 120 is stored in a register to be used for a semiconductor memory apparatus operation.

However, the conventional temperature information output apparatus has the following disadvantages.

Firstly, the BGR circuit 110 of the temperature information output apparatus and the BGR circuit 200 that generates the reference voltage for the internal power are both arranged in the semiconductor memory apparatus, which increases the circuit size.

Secondly, power consumption is high because two BGR circuits are provided.

Lastly, it takes a very long time until the output voltage of the BGR circuit 110 in the temperature information output apparatus 100 becomes stabilized and effective temperature information is output, thereby significantly delaying a memory apparatus operation.

SUMMARY

Embodiments of the present invention may provide a BGR circuit in which power consumption is low and the circuit size is small.

Embodiment of the present invention also may provide a temperature information output apparatus having a BGR circuit which outputs temperature information quickly and stably.

An embodiment of the present invention provides a BGR circuit comprising: a temperature-proportional current generating part that generates a current in proportion to a change in temperature through a plurality of current paths; a temperature-inverse proportional current generating part that generates a current in inverse proportion to a change in temperature through a plurality of current paths; an internal voltage reference voltage generating part that generates a reference voltage for an internal voltage using the current of the temperature-proportional current generating part and the current of the temperature-inverse proportional current generating part; and a temperature voltage output part that outputs a voltage corresponding to a change in temperature.

Another embodiment of the present invention provides a temperature information output apparatus comprising: a band gap reference (BGR) circuit that generates and outputs an internal voltage reference voltage which varies depending on a change in temperature and an analog temperature voltage corresponding to a change in semiconductor memory apparatus internal temperature using band gap characteristics; an analog-to-digital converter (ADC) that converts the analog temperature voltage to digital temperature information in response to a first control signal and initializes the digital temperature information in response to a second control signal; and a controller that outputs the first control signal in response to at least one operation command.

A further understanding of the nature and advantages of the present invention may be realized by reference to the remaining portions of the specification and the attached drawings.

BRIEF DESCRIPTION OF THE FIGURES

Non-limiting and non-exhaustive embodiments of the present invention will be described with reference to the following figures, wherein like reference numerals refer to like parts throughout the various figures unless otherwise specified. In the figures.

DETAILED DESCRIPTION OF EXEMPLARY EMBODIMENT

Figure 1:
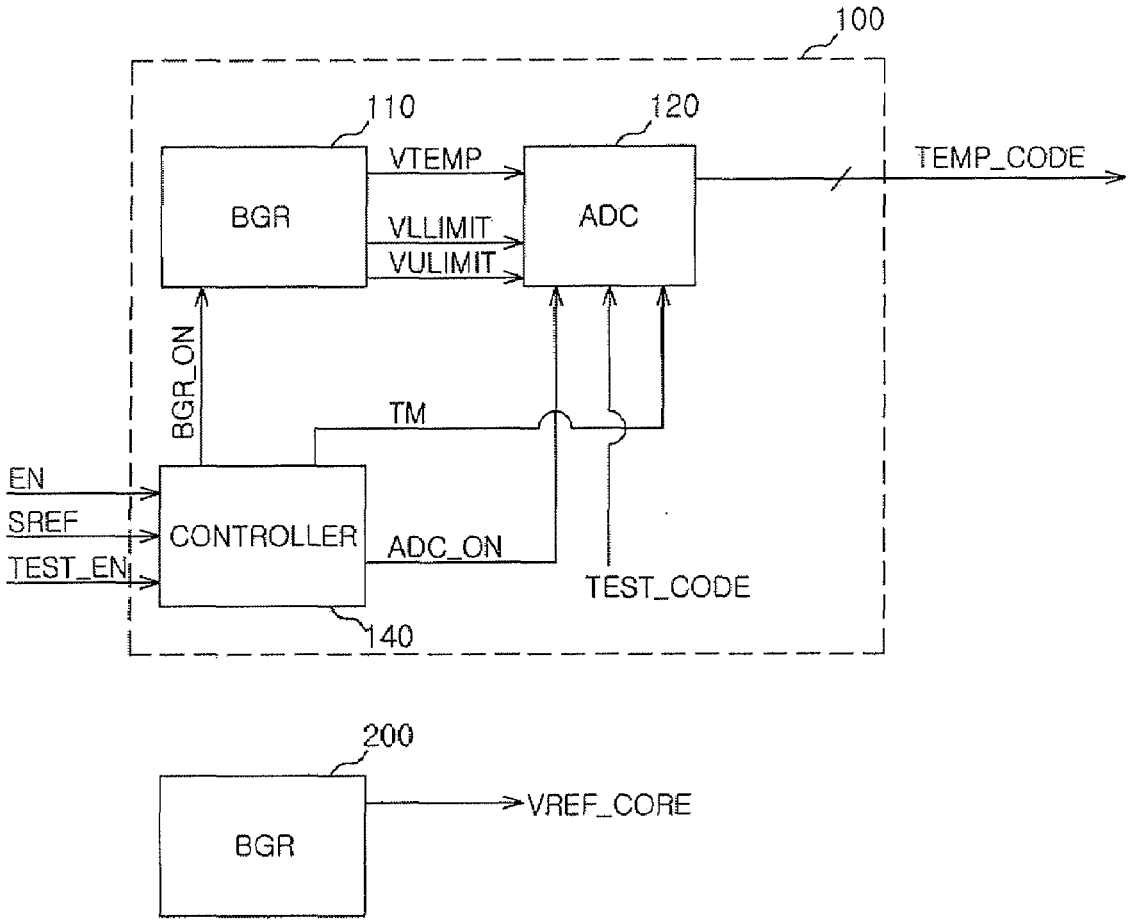
FIG.1 (PRIOR ART)
FIG. 1 is a block diagram of a conventional temperature information output apparatus.
Figure 2:
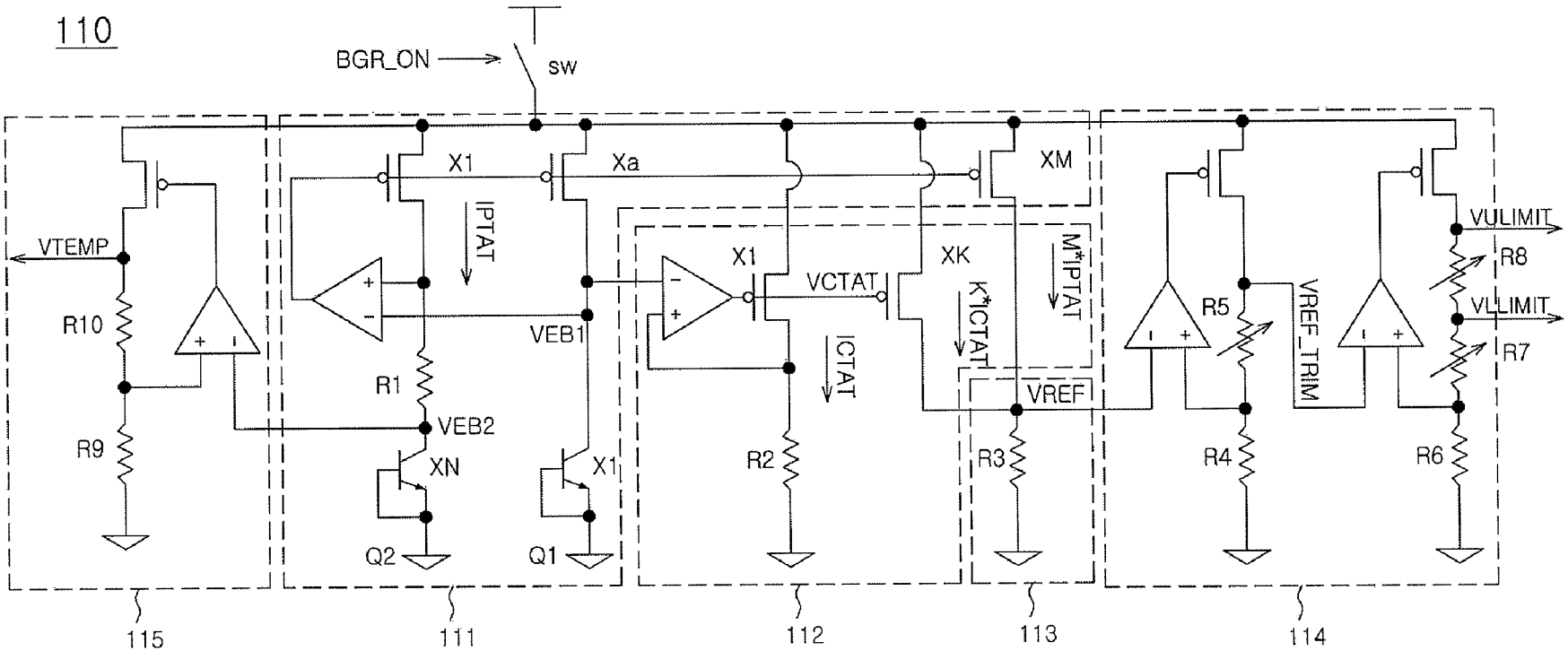
FIG.2 (PRIOR ART)
FIG. 2 is a circuit diagram of the BGR circuit 110 of FIG. 1.
Figure 3:
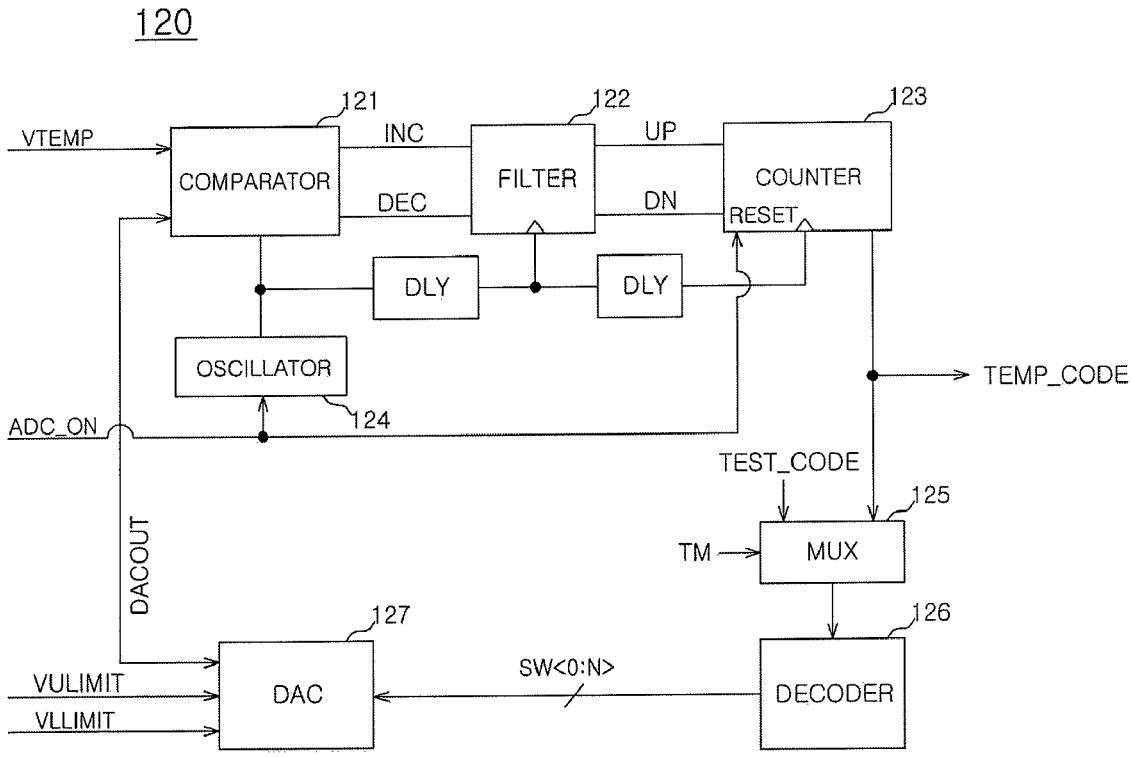
FIG.3 (PRIOR ART)
FIG. 3 is a block diagram of the ADC of FIG. 1.

Preferred embodiments of the present invention will be described below in more detail with reference to the accompanying drawings. The present invention may, however, be embodied in different forms and should not be construed as being limited to the embodiments set forth herein. Rather, these embodiments are provided so that this disclosure will be thorough and complete, and will fully convey the scope of the present invention to those skilled in the art. Like reference numerals refer to like elements throughout the accompanying figures.

Hereinafter, an exemplary embodiment of the present invention will be described in conjunction with the accompanying drawings.

Figure 5:
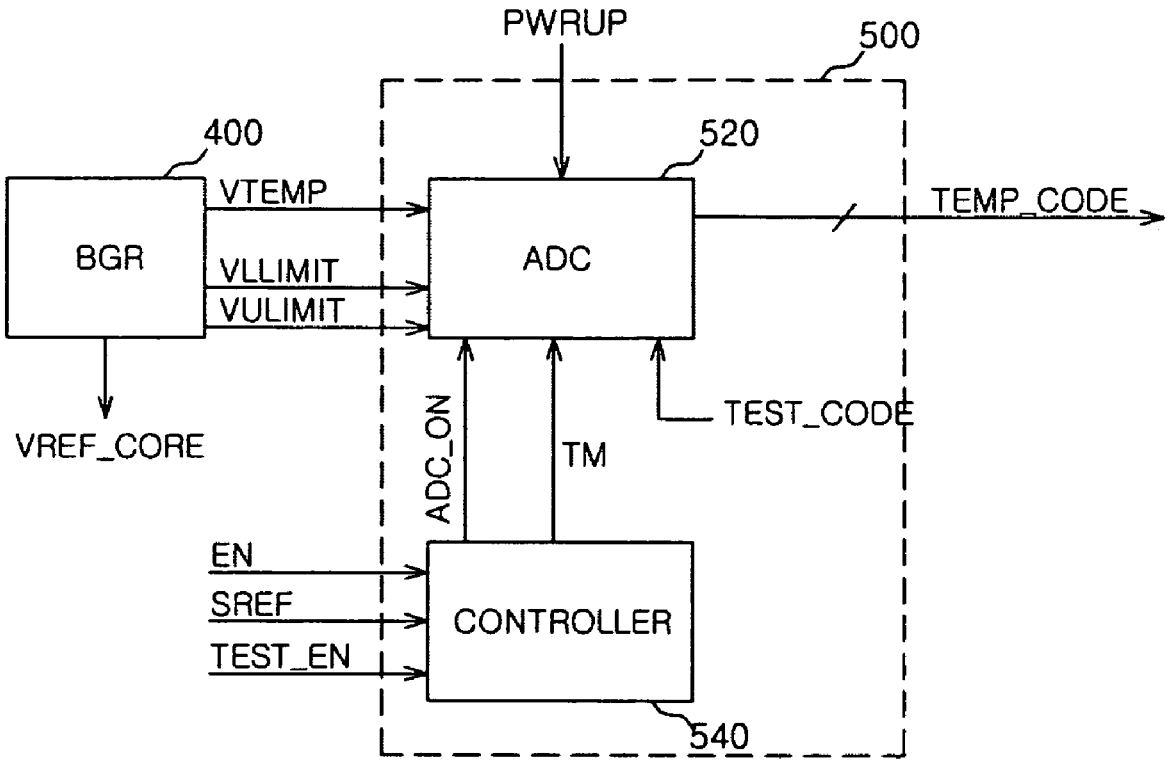
FIG. 5 is a block diagram of a temperature information output apparatus according to an exemplary embodiment of the present invention.

As shown in FIG. 5, an exemplary the temperature information output apparatus includes: a BGR circuit 400 which may generate and output an internal voltage reference voltage VREF_CORE which varies depending on a change in temperature using band gap characteristics; an analog temperature voltage VTEMP that corresponds to a change in internal temperature of the semiconductor memory apparatus and reference voltages VLLIMIT and VULIMIT for range limits; an ADC 520 which may operate in response to a first control signal ADC_ON to convert VTEMP to digital temperature information TEMP_CODE, and may initialize TEMP_CODE in response to a second control signal PWRUP; and a controller 540 which may output ADC_ON in response to at least one operation command.

The BGR circuit 400 may be arranged at the same location as the BGR circuit 200 of FIG. 1, and may perform the function of the BGR circuit 110 to generate VTBMP, VLLIMIT and VULIMIT as well as the function of the BGR circuit 200 to generate VREF_CORE used as a reference for generating an internal voltage. Because one of the two BGR circuits (i.e., BGR circuit 110) is removed as compared to the conventional temperature information output apparatus of FIG. 1, the circuit size is significantly reduced.

Figure 6:
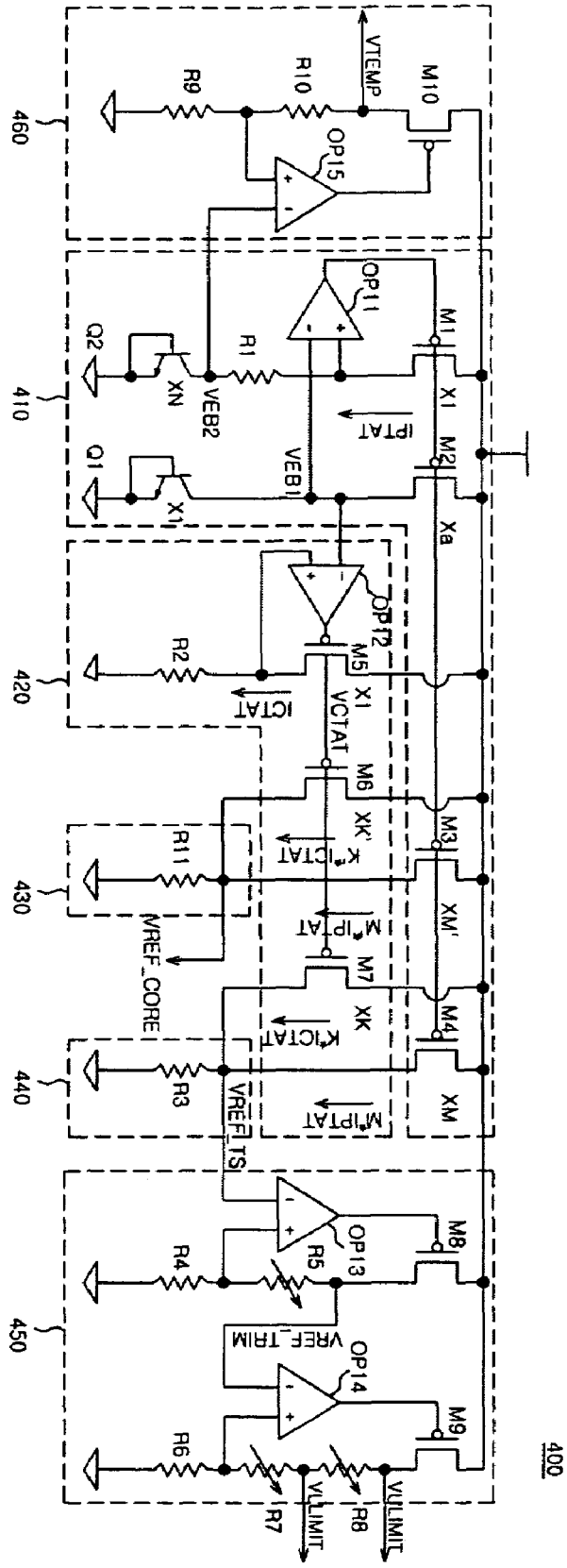
FIG. 6 is a circuit diagram of a BGR circuit according to an exemplary embodiment of the present invention.

The BGR circuit 400, as shown in FIG. 6, may include: a temperature-proportional current generating part 410 which may generate a current in proportion to a change in temperature through a plurality of current paths using a temperature coefficient characteristic voltage; a temperature-inverse proportional current generating part 420 which may generate a current in inverse proportion to a change in temperature through a plurality of current paths; an internal voltage reference voltage generating part 430 that may generate VREF_CORE using the current of the temperature-proportional current generating part 410 and the current of the temperature-inverse proportional current generating part 420; a temperature information reference voltage generating part 440 that may generate a temperature information reference voltage VREF_TS using the current of the temperature-proportional current generating part 410 and the current of the temperature-inverse proportional current generating part 420; a range limit reference voltage generating part 450 that may generate a low limit reference voltage VLLIMIT and an upper limit reference voltage VULIMIT which may be used to limit the range of VTEMP using the temperature information reference voltage VREF_TS; and a temperature voltage output part 460 that may generate VTEMP, which corresponds to a change in current internal temperature of the semiconductor memory apparatus using the temperature coefficient characteristic voltage.

The temperature-proportional current generating part 410 may include: a first transistor group M1 to M4 including a plurality of field effect transistors (FETs) whose sources are coupled to a power source terminal; a second transistor group Q1 and Q2 including diode coupled bipolar junction transistors (BJTs) which are coupled between the transistors M1 and M2 and a ground terminal and have a negative temperature coefficient characteristic; and a differential amplifier OP11 which serves as a current controller to amplify a difference between emitter-base voltages VEB1 and VEB2 of the second transistor group Q1 and Q2 and commonly apply it to the gates of the first transistor group M1 to M4, thereby controlling the amount of current in the first transistor group M1 to M4. The first transistor group M1 to M4 and the second transistor group Q1 and Q2 may have different sizes so that they produce predetermined multiplying factors, examples of which are indicated on right sides thereof. Let us assume that X1, which is multiplying factor of the transistor M1, is a basic multiplier. Xa is "a" times X1, and XM is "M" times X1; Thus, if a current which flows through the transistor M1, which is multiplied by X1, is "IPTAT", a current which flows through the transistor M4 is multiplied by XM to produce "M*IPTAT". The emitter-base voltages of the second transistor group Q1 and Q2 comprised of the diode coupled BJTs have a negative temperature coefficient characteristic. That is, the emitter-base voltages of the second transistor group Q1 and Q2 get lower as the temperature gets higher.

The temperature-inverse proportion current generating part 420 may include a plurality of transistors M5 to M7 whose sources are commonly coupled to a power source terminal and a differential amplifier OP12 which serves as a current controller to amplify a difference between a voltage according to a current flowing through the transistor M5 and VEB1, and commonly apply it to the gates of the transistors M5 to M7, thereby controlling the amount of current in the transistors M5 to M7. The transistors M5 to M7 may have different sizes so that they produce predetermined multiplying factors, examples of which are indicated on the right sides thereof.

The internal voltage reference voltage generating part 430 may include a resistor R11 which may be commonly coupled to one of the current paths of the temperature-proportional current generating part 410 and one of the current paths of the temperature-inverse proportional current generating part 420. The sum of the two current paths coupled to the resistor R11 varies according to the temperature. That is, the resistor R11 has one end commonly coupled to the drains of the transistors M3 and M6 which are two current paths and the other end is coupled to a ground, and VREF_CORE is output from a connection node where the drains of the transistors M3 and M6 and the resistor R11 are coupled. VREF_CORE should be raised as the temperature is lowered, however since a threshold voltage is higher due to the characteristics of a MOS FET, this phenomenon is compensated for to make the current transmission of a cell capacitor and a bit line smooth as the temperature is lowered. Thus, multiplying factors of the transistors M3 and M6 may be respectively set to XM' and XK' so that the transistor M6 varies the range of the current more than the transistor M3.

The temperature information reference voltage generating part 440 may include a resistor R3 which may be commonly coupled to one of the current paths of the temperature-proportional current generating part 410 and one of the current paths of the temperature-inverse proportional current generating part 420. The sum of the two current paths coupled to the resistor R3 is constant regardless of the temperature. That is, the resistor R3 has one end commonly coupled to the drains of the transistors M4 and M7 which are two current paths, and the other end is coupled to a ground. VREF_TS is output from a connection node where the drains of the transistors M4 and M7 and the resistor R3 are coupled. VREF_TS affects an output of the temperature information output apparatus and thus should be maintained as a constant regardless of variations in process, voltage and temperature (PVT). Multiplying factors of the transistors M4 and M7 may be respectively set to XM and XK so that the transistors M4 and M7 vary the range of the current equally.

The range limit reference voltage generating part 450 may include: a first transistor M8 whose source is coupled to the power source terminal; first division resistors R4 and R5 coupled between the first transistor M8 and the ground terminal; a differential amplifier OP13 which serves as a first current controller to amplify a difference between a divided voltage of the first division resistors R4 and R5 and VREF_TS and apply it to the gate of the first transistor M8, thereby controlling the amount of current in the first transistor M8; a second transistor M9 whose source is coupled to the power source terminal, second division resistors R6 to R8 coupled between the second transistor M9 and the ground terminal; a differential amplifier OP14 which serves as a second current controller to amplify a difference between a voltage of a connection node where the first transistor M8 and the first division resistors R4 and R5 are coupled, i.e., a trimming voltage VREF_TRIM, and a divided voltage of the second division resistors R6 to R8 and amplifies it to the gate of the second transistor M9, thereby controlling the amount of current in the second transistor M9. VULIMIT is output from a connection node of the second transistor M9 and the resistor R8, and VLLIMIT is output from a connection node of the resistors R7 and R8. The resistors R5, R7 and R8 may be variable resistors, the levels of VLLIMIT and VULIMIT may be modified by adjusting the resistance values of the resistors R7 and R8, and offsets of VLLIMIT and VULIMIT may be modified by adjusting a resistance value of the resistor R5.

The temperature voltage output part 460 may include a transistor M10 whose source is coupled to the power source terminal; division resistors R10 and R9 coupled between a drain of the transistor M10 and the ground terminal; and a differential amplifier OP15 which serves as a current controller to amplify a difference between a divided voltage of the division resistors R10 and R9 and VEB2 and apply it to the gate of the transistor M10, thereby controlling the amount of current in the transistor M10. VTEMP is output from a connection node of the transistor M10 and the resistor R10.

Figure 7:
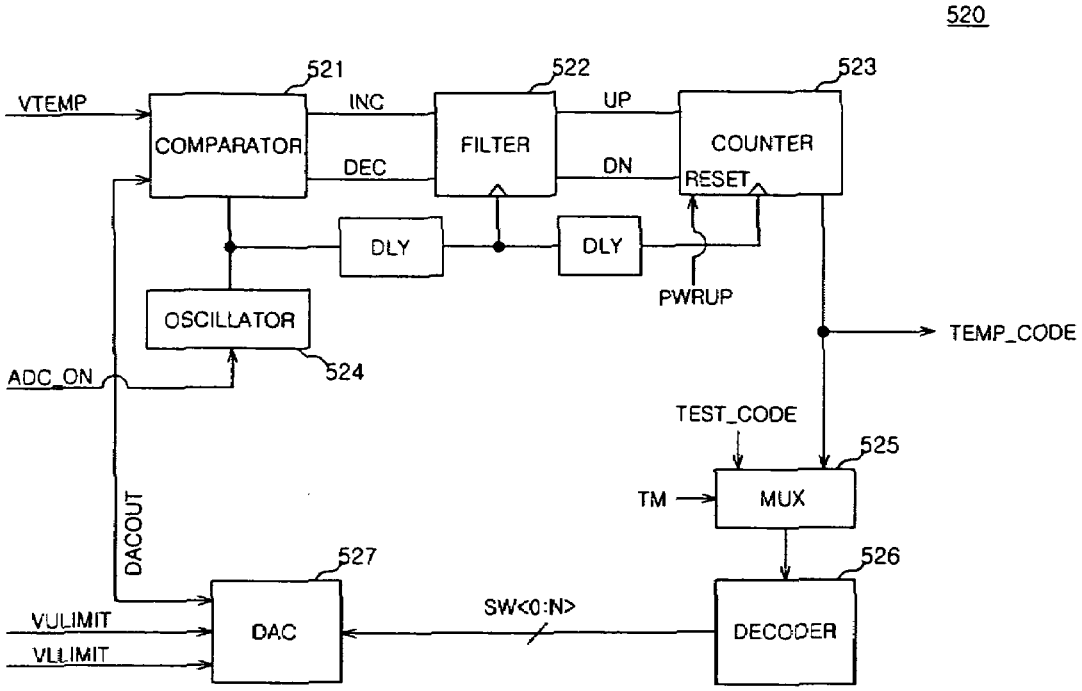
FIG. 7 is a block diagram of an ADC according to the exemplary embodiment of the present invention.
Figure 8:
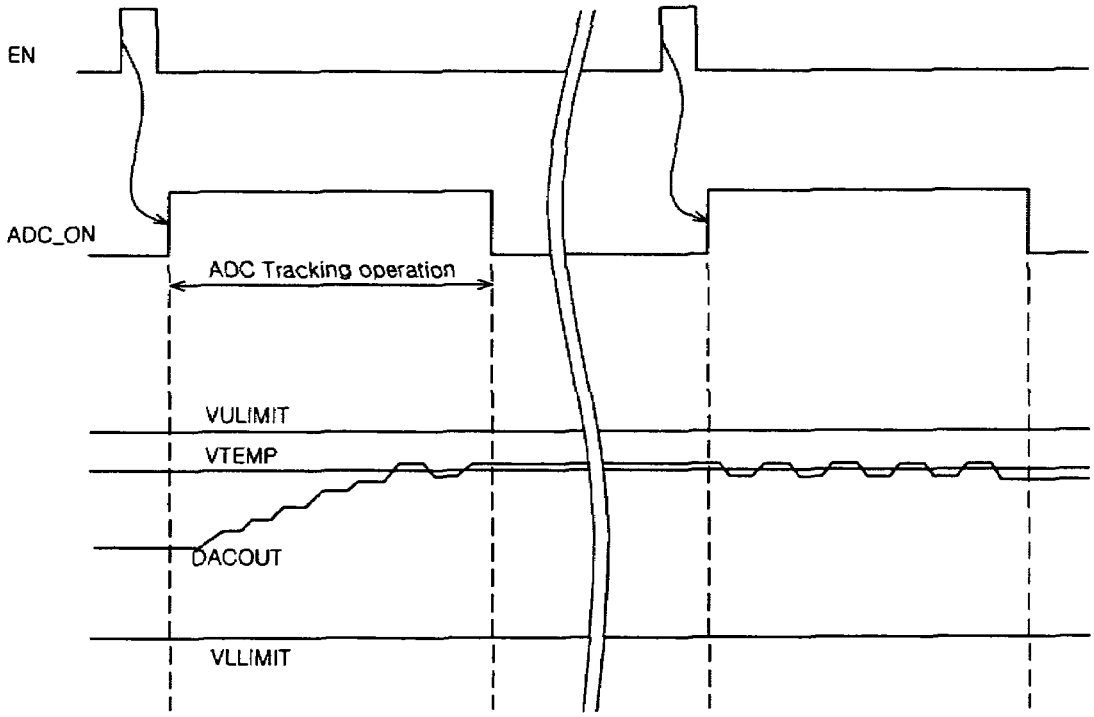
FIG. 8 is a timing diagram illustrating an operation of the temperature information output apparatus of FIG. 5.

The ADC 520, as shown in FIG. 7, may include a comparator 521, a filter 522, a counter 523, an oscillator 524, a multiplexer MUX 525, a decoder 526, and a DAC 527. The comparator 521 compares VTEMP and DACOUT, which are analog signals, to output a difference between VTEMP and DACOUT as digital codes INC and DEC. The filter 522 does not perform an output operation when INC and DEC vary radically, that is, when they have a high frequency component due to external noise. However, when INC and DEC vary dilatorily, that is, when they have a low frequency component, the filter 522 outputs a signal UP for the counter 523 to up-count and a signal DN for the counter 523 to down-count. The counter 523 increases and decreases an initial TEMP_CODE (e.g., 100000) in response to the UP and DN signals, respectively. The counter 523 receives a PWRUP signal through a reset terminal RESET. The oscillator 524 operates when the ADC_ON signal is at high level to generate a clock signal having a predetermined period and provides it to the filter 522 and the counter 523 through a delay DLY so that the filter 522 and the counter 523 can operate. The multiplexer MUX 525 outputs a test code TEST_CODE or TEMP_CODE in response to a test mode signal TM. The decoder 526 decodes an output of the multiplexer MUX 525 to output a decoding signal SW<0:N>. The DAC 527 converts the decoding signal SW<0:N> to DACOUT to the extent that VULIMIT and VLLIMIT are not exceeded. The ADC 520 is different from the conventional ADC because, for example, the counter 523 is not reset by the ADC_ON signal, but the PWRUP signal. The conventional temperature information output apparatus outputs VTEMP after the BGR circuit operates and a predetermined stabilization time lapses, but in embodiments of the temperature information output apparatus of the present invention, since VTEMP may be stably output until the BGR circuit 400 is powered off, the counter 523 may be reset by the PWRUP signal which indicates that an initial power level has been stabilized.

The controller 540 outputs the ADC_ON signal when a temperature information output apparatus enable signal EN or a self refresh signal SREF is enabled, and output both the ADC_ON signal and a test mode signal TM to control whether to perform a test mode or not when a test mode enable signal TEST_EN is enabled.

An exemplary operation of the temperature information output apparatus according to an exemplary embodiment of the present invention will be described below.

First, the controller 540 enables the BGR_ON signal to high level when it receives the enabled EN signal or the enabled SREF signal.

Figure 4:
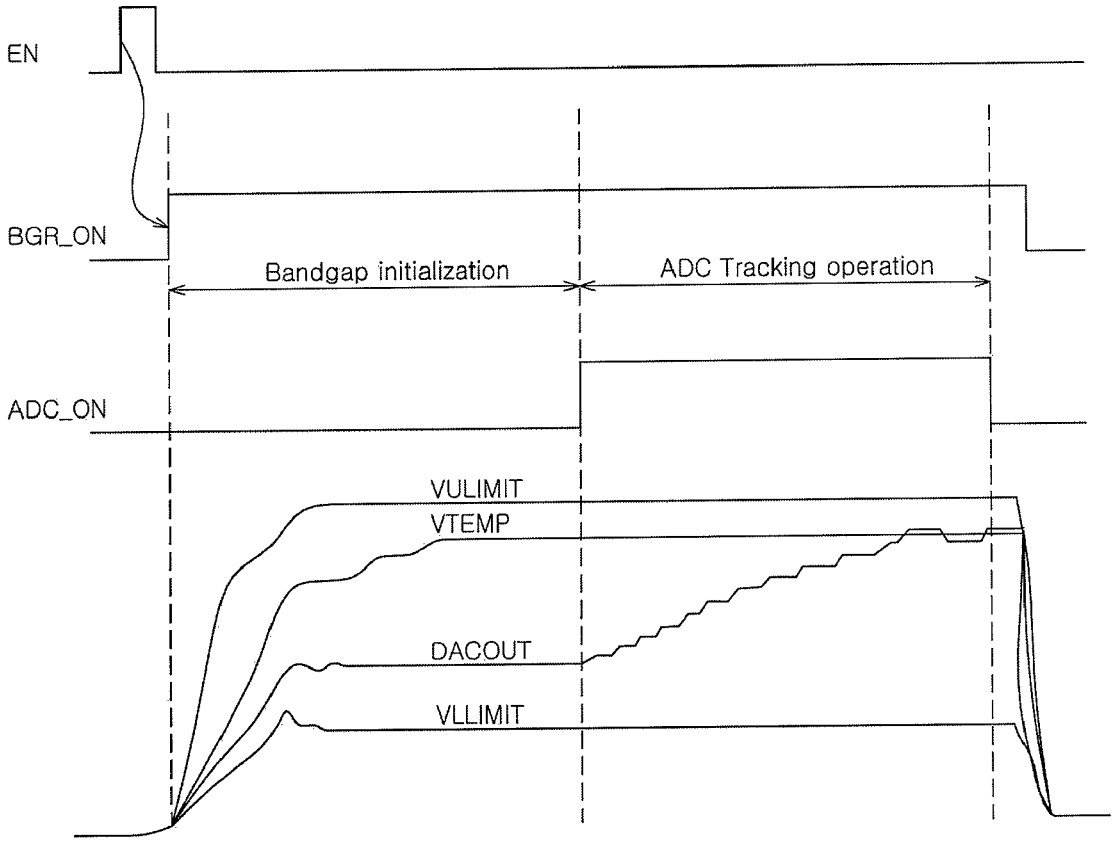
FIG.4 (PRIOR ART)
FIG. 4 is a timing diagram illustrating an operation of the temperature information output apparatus of FIG. 1.

At this time, the BGR circuit 400 starts to operate from the time when power is supplied to the semiconductor memory apparatus and stably outputs VREF_CODE, VTEMP, VULIMIT, and VLIMIT. Thus, the ADC_ON signal may be enabled to a high level directly after EN is enabled, so that the ADC 520 can operate without a gap initialization operation, contrary to the conventional art of FIG. 4.

The ADC 520 may perform an ADC tracking operation while the ADC_ON signal is at high level.

When the ADC tracking operation is almost finished DACOUT and VTEMP become equal in level and when the ADC tracking operation is complete the ADC 520 outputs TEMP_CODE. At this time, since the counter 523 of the ADC 520 is reset by PWRUP, a counting value of a previous ADC_ON enable period, i.e., TEMP_CODE is stored in the counter 523. Thus, since DACOUT has a value close to a value corresponding to the current temperature, the ADC tracking operation is more rapidly performed than that of the conventional art.

When the above-described operation is completed, that is, when the ADC_ON signal becomes low level, the operation of the temperature information output apparatus is finished, and TEMP_CODE output from the ADC 520 is stored in a register to be used for a semiconductor memory apparatus operation. The final counting value of the counter 523 is the same counting value as TEMP_CODE output to the register, and is maintained until the PWRUP signal is input again.

The BGR circuit and the temperature information output apparatus according to an exemplary embodiment of the present invention may have the following advantages.

First, the circuit size is reduced since only one BGR circuit is arranged in the semiconductor memory apparatus, if the semiconductor memory apparatus includes a temperature information output apparatus.

Second, power consumption is low since only one BGR circuit operates.

Third, an operation speed of the semiconductor memory apparatus is improved since a time for an output voltage stabilization of the BGR circuit is not needed.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A temperature information output apparatus, comprising:

a band gap reference (BGR) circuit configured to generate and output an internal voltage reference voltage which varies depending on a change in temperature and an analog temperature voltage corresponding to a change in semiconductor memory apparatus internal temperature using band gap characteristics;

an analog-to-digital converter (ADC) configured to convert the analog temperature voltage to digital temperature information in response to an activation a first control signal and initialize the digital temperature information in response to a second control signal, wherein the second control signal is a power up signal; and a controller configured to activate the first control signal in response to an activation of at least one operation command.

2. The temperature information output apparatus as set forth in claim 1, wherein the BGR circuit comprises:

a temperature-proportional current generating part configured to generate a current in proportion to a change in temperature through a plurality of current paths;

a temperature-inverse proportional current generating part configured to generate a current in inverse proportion to the change in temperature through a plurality of current paths;

an internal voltage reference voltage generating part configured to generate a reference voltage for an internal voltage using the current of the temperature-proportional current generating part and the current of the temperature-inverse proportional current generating part; and a temperature voltage output part configured to output a voltage corresponding to a change in temperature.

3. The temperature information output apparatus as set forth in claim 2, wherein the temperature-proportional current generating part comprises:

a first transistor group comprised of a plurality of transistors commonly coupled to a power source terminal;

a second transistor group comprised of a plurality of transistors coupled between some of the transistors of the first transistor group and a ground terminal, and having a negative temperature coefficient characteristic; and a current controller configured to control the first transistor group using a voltage applied to the transistors of the second transistor group.

4. The temperature information output apparatus as set forth in claim 2, wherein the temperature-inverse proportional current generating part comprises:

a plurality of transistors commonly coupled to a power source terminal; and a current controller configured to control the plurality of transistors using a voltage according to a current which flows through one of the plurality of transistors and an internal voltage of the temperature-proportional current generating part.

5. The temperature information output apparatus as set forth in claim 2, wherein the internal voltage reference voltage generating part comprises a resistor element commonly coupled to two current paths, one of the current paths being in the temperature-proportional current generating part and one of the current paths being in the temperature-inverse proportional current generating part, and the sum of the currents flowing through the two current paths varies according to the temperature.

6. The temperature information output apparatus as set forth in claim 2, wherein the temperature voltage output part comprises:

a node from which the temperature voltage is output;

a transistor coupled between the node and a power source terminal;

a resistor coupled between the node and a ground terminal; and a current controller configured to control the transistor using a voltage divided by the resistor and an internal voltage of the temperature-proportional current generating part.

7. The temperature information output apparatus as set forth in claim 1, wherein the ADC comprises a counter, wherein digital temperature information output from the counter is initialized in response to the second control signal.

* * * * *